United States Patent [19]

Niikawa

[11] Patent Number: 4,925,325

[45] Date of Patent: May 15, 1990

[54] RECORDING PAPER TRANSPORTING DEVICE IN A RECORDING APPARATUS

[75] Inventor: Takeshi Niikawa, Nagoya, Japan

[73] Assignee: Brother Kogyo Kabushiki Kaisha, Japan

[21] Appl. No.: 185,761

[22] Filed: Apr. 25, 1988

[30] Foreign Application Priority Data

Apr. 23, 1987 [JP] Japan ..... 62-100989
May 7, 1987 [JP] Japan ..... 62-111795

[51] Int. Cl.[5] ..... B41J 11/42

[52] U.S. Cl. ..... 400/582; 400/583; 400/605; 400/613.1; 400/619

[58] Field of Search ..... 400/605, 636.2, 669, 400/619, 551, 620, 582, 583, 583.2, 583.3, 608.3, 578, 642, 611, 613.1

[56] References Cited

U.S. PATENT DOCUMENTS

| | | | |
|---|---|---|---|
| 3,276,562 | 10/1966 | Mathews | 400/549 |
| 3,960,258 | 6/1976 | Aebi | 400/550 |
| 4,234,261 | 11/1980 | Hendrischk et al. | 400/551 |
| 4,266,880 | 5/1981 | Buchanan | 400/550 |
| 4,272,205 | 6/1981 | Bisczat et al. | 400/575 |
| 4,619,197 | 10/1986 | Pailler | 400/605 |
| 4,655,626 | 4/1987 | Okazaki | 400/605 |
| 4,761,087 | 2/1988 | Ward et al. | 400/605 |
| 4,780,012 | 10/1988 | Kikuchi et al. | 400/582 |
| 4,798,374 | 1/1989 | Ito | 400/636.2 |

FOREIGN PATENT DOCUMENTS

| | | | |
|---|---|---|---|
| 226327 | 11/1986 | European Pat. Off. . | |
| 230753 | 12/1984 | Japan | 400/620 |

OTHER PUBLICATIONS

C. Itoh User Manual selected pages on sale 1985.
Print View and Return Device, Blaskovic et al, IBM Tech Discl Bulletin, vol. 24, No. 1A pp. 395–397, 6–81.
Paper Takeup . . . FitzGibbons et al, IBM Tech Discl Bulletin, vol. 23, No. 5 pp. 2159–2160, 10–80.

*Primary Examiner*—Eugene H. Eickholt
*Attorney, Agent, or Firm*—Finnegan, Henderson, Farabow, Garrett & Dunner

[57] ABSTRACT

A printer of the type in which printing is performed in response to data supplied from a host computer and the printer is selectively rendered in an on-line mode enabling to receive the data from the host computer and in an off-line mode disabling to receive the data therefrom. A recording paper is firstly moved beyond a reference line by a desired length corresponding to a desired amount of upper margin of the recording paper. The recording paper is then moved backwardly by a distance between a print position and the reference line, whereby the desired amount of upper margin is reserved when printing is started. In another aspect of the invention, an elongated, web-like recording sheet is moved toward a cutting blade and is cut at an appropriate line on the sheet. Then, the sheet is backwardly moved by a predetermined distance toward the print position.

16 Claims, 11 Drawing Sheets

RECORDING PAPER TRANSPORTING DEVICE IN A RECORDING APPARATUS

BACKGROUND OF THE INVENTION

The present invention relates generally to a recording apparatus, and more particularly to a printer of the type having a print head, a paper transporting unit for transporting a print paper through the print head, and a cutting unit for cutting the print paper.

In a conventional printer, the print head is provided in the interior of a body of the printer, and usually the print position is not visible from the outside of the printer. When it is intended to align a leading print line of the print paper with the print position of the print head, it has been difficult to carry out the alignment while visually confirming the print position.

Further, since a pair of paper feed rollers is located between the print head and the paper cutting unit and thus the paper cutting unit is located apart from the print head, it is difficult to position the paper cutting unit adjacent the print head. Accordingly, when printing is performed upon cutting the upper edge line of the print paper, a large blank space is provided in the top portion of the print paper, thereby causing inbalanced printing arrangement.

SUMMARY OF THE INVENTION

Accordingly, it is an object of the invention to eliminate the above-described drawbacks in the prior art techniques and to provide a printer in which the print paper can be registered in a predetermined position.

Another object of the invention is to provide a printer in which a leading print line is correctly set to a print position of the print head.

Still another object of the invention is to provide a printer in which a predetermined cut line of a continuous print sheet can be aligned with the paper cutting position.

These and other objects of the invention can be achieved by providing a recording apparatus which comprises recording means for recording a data on a recording medium; accommodating means for accommodating at least the recording means; transporting means for transporting the recording medium in a first direction and a second direction opposite to the first direction along a transportation path, the recording means being disposed alongside the transportation path so as to be recordable on the recording medium and the recording medium being transported in the first direction to be discharged to an output position when the recording means has recorded the data on the recording medium; registration means arranged in a position visible from outside of the accommodating means, the registration means being positioned between the recording means and the output position and apart from by a predetermined distance along the transportation path from the recording means; aligning means for aligning a predetermined line perpendicular to the first direction or the second direction on the recording medium with the registration means; and control means for controlling the transportation means to transport the recording medium by the predetermined distance in the second direction, whereby printing can be started from the predetermined line on the recording medium.

A recording apparatus according to another aspect of the invention comprises: recording means for recording a data on an elongated, web-like recording medium; cutting means for cutting the recording medium; transporting means for transporting the recording medium in a first direction and a second direction opposite to the first direction along a transportation path; first operating means for operating the transporting means to transport the recording medium by a predetermined distance in the first direction for the cutting means out the recording means; and second operating means for operating the transporting means to transport the recording medium by the predetermined distance in the second direction.

DETAILED DESCRIPTION OF THE PREFERRED EMBODIMENTS

Figure 1:
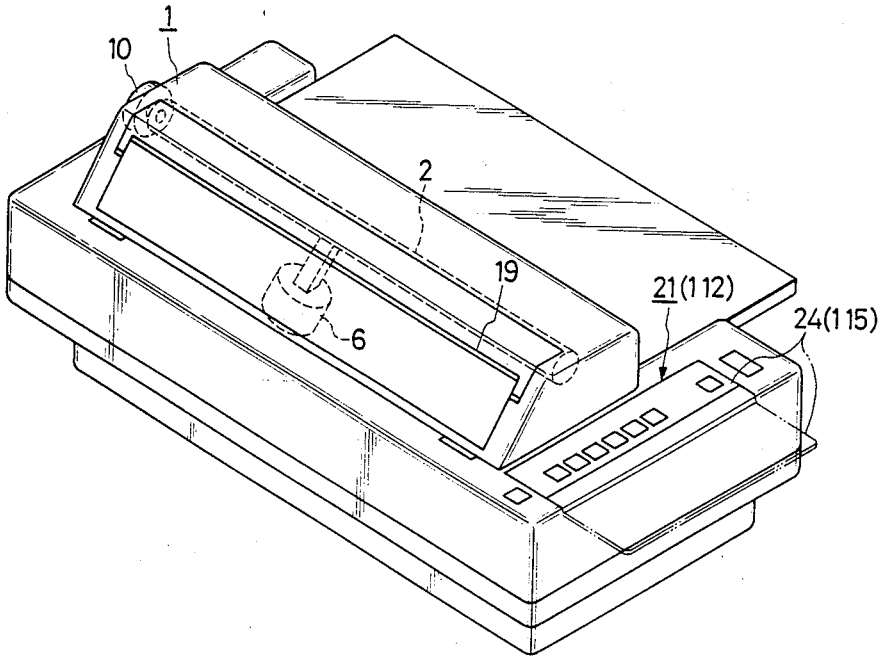
FIG. 1 is a perspective view showing a printer according to one embodiment of this invention.
Figure 2:
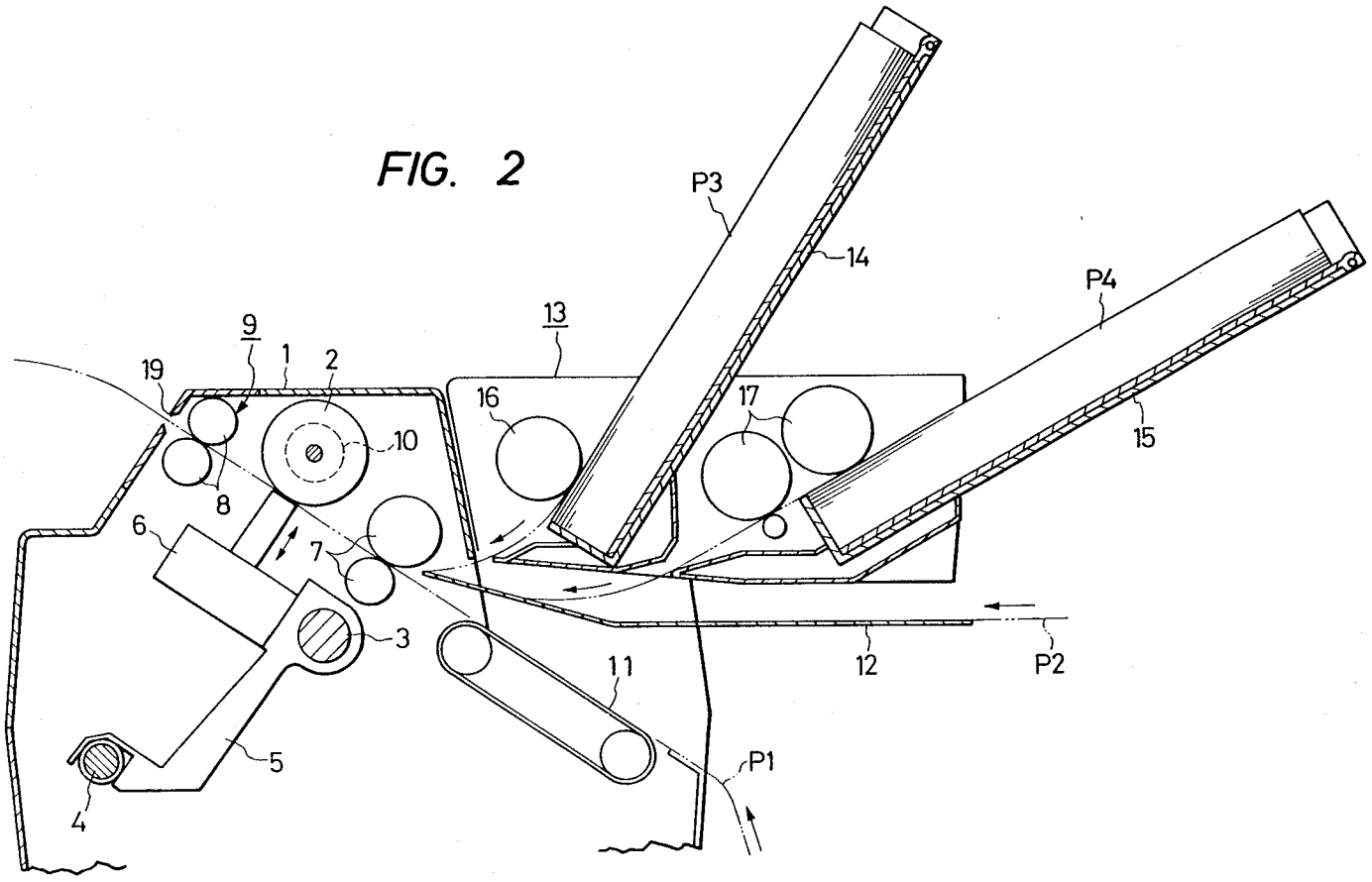
FIG. 2 is a cross-sectional side view showing the printer as shown in FIG. 1 as viewed from the left side.

FIG. 1 is a perspective view showing a printer as embodied herein and FIG. 2 is a cross-sectional side view of the printer in FIG. 1. Referring to FIGS. 1 and 2, a platen 2 is rotatably supported by a body or housing 1 of the printer, and two guide rods 3 and 4 extending in parallel to the platen 2 are disposed below the platen 2. A carriage 5 is movably mounted along the guide rods 3 and 4, and a printing head 6 is mounted on the carriage 5. The printing head 6 also moves along the guide rods 3 and 4 while confronting the platen 2. Two pairs of feed rollers 7 and 8 are disposed at the front and rear sides of the printer with the platen 2 intervening therebetween. A print paper passes through a nip between the outer peripheral surface of the platen 2 and the printing head 6 in accordance with rotations of the feed rollers 7 and 8. A transporting unit 9 is constituted with the platen 2, the feed rollers 7 and 8, a drive motor (not shown) and a gear means (not shown) for rotating the rollers 7 and 8 in accordance with the rotations of the motor. An operation knob 10 is secured at one end of the platen 2 and is positioned outside of the housing. By manually operating the operation knob 10, the print paper is moved.

A pin tractor 11 is disposed adjacent the feed roller and at the paper feeding side so that an elongated, web-like print paper P1 is fed into a nip between the feed rollers 7 in accordance with the rotations of the pin tractor. A guide plate 12 is disposed above the pin tractor 11 substantially horizontally with respect to the printer body 1. A print paper P2 of the kind, such as a single sheet of paper or envelop, is manually inserted one by one into the nip between the feed rollers 7 by the aid of the guide plate 12.

An automatic paper feeding unit 13 is disposed above the guide plate 12 and is secured to the printer body 1. The paper feeding unit 13 includes two sheet cassettes 14 and 15 respectively stacking therein print papers P3 and P4 of different sizes. Feed rollers 16 and 17 are provided in association with the sheet cassettes 14 and 15, respectively. The feed rollers 16 and 17 are selectively rotated to feed out the uppermost paper into the nip between the feed rollers 7.

The printer as constructed above has two operation modes, one being an on-line mode enabling to receive output data from a host computer 18 (see FIG. 5) and another being an off-line mode disabling to receive the output data from the host computer 18. In the on-line mode, the printing head 6 is operated to carry out printing on the print paper in accordance with the output data from the host computer 18.

A registration/cutting blade member 19, which serves not only as the registration member but also as a cutting blade, is disposed at a paper discharge port of the printer body 1 to be visible from the outside of the printer. The registration member 19 is positioned in downstream of the printing head 6 in the paper transporting direction apart by a predetermined distance from the printing head 6. When it is intended to set the leading print line of the continuous printing paper P1 or when it is intended to determine the amount of upper margin of the print papers P2, P3 or P4, the position of the registration member 19 serves as a reference position.

On the other hand, when the registration member 19 serves as the cutting blade, the perforated scored line M (FIG. 6A) formed in the print paper P1 is aligned with the blade and the print gaper P1 is pressed against the cutter blade to thereby cut the print paper P1.

Figure 4:
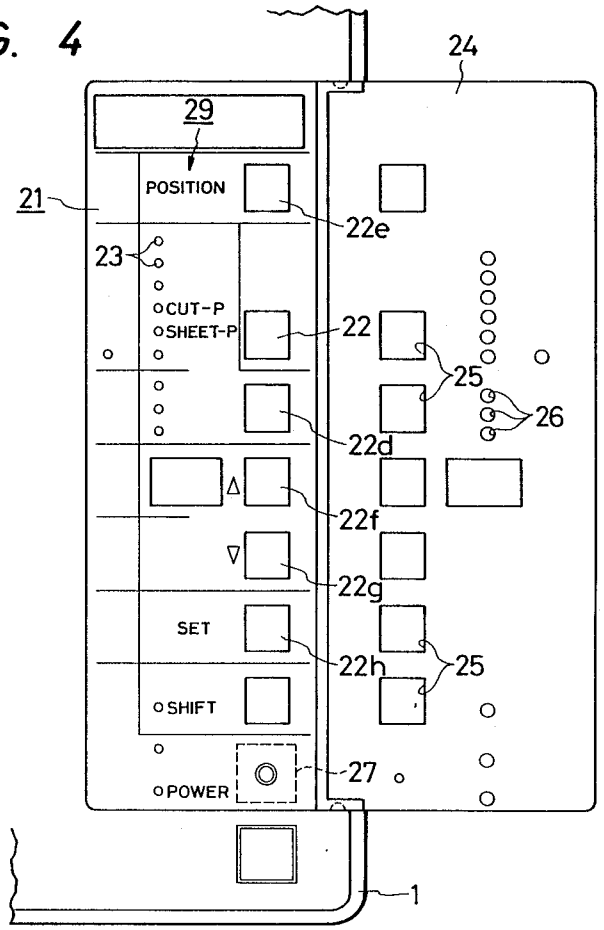
FIG. 4 is a top plan view showing the operation unit provided in the printer of FIG. 1 with the lid member being opened.
Figure 3:
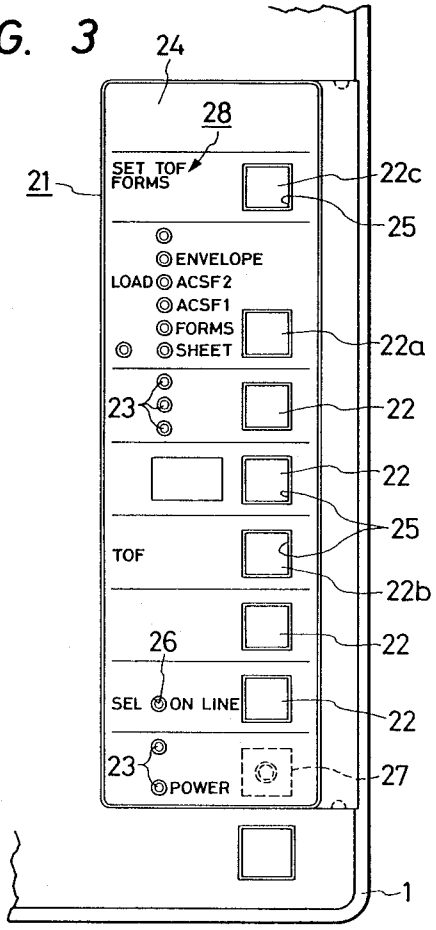
FIG. 3 is a top plan view showing an operation unit provided in the printer of FIG. 1 with a lid member being closed.

Referring to FIGS. 1, 3 and 4, an operation unit 21 is provided on the left side of an upper surface of the printer body. The operation unit 21 includes a plurality of versatile function switches 22 allotted with various kinds of functions and display lamps 23. A lid member 24 is pivotally supported by the printer body, and is provided with a plurality of through-holes 25 and 26 formed at positions corresponding to the locations of the switches 22 and the display lamps 23. A change-over switch 27 is further provided on the surface of the operation unit 21 to be switched on or off in accordance with the opening or closing of the lid member 24. When the lid member 24 is closed as shoWn in FIG. 3, the printer is rendered in on-line mode, in the case of which the functions of the switches 22 and the display lamps 23 are changed to those described on the outer surface 28 of the lid member 24 On the other hand, when the lid member 24 is opened as shown in FIG. 4, the printer is rendered in off-line mode, in the case of which the functions of the switches 22 and the display lamps 23 are changed to those described on the exposed surface 29.

Figure 5:
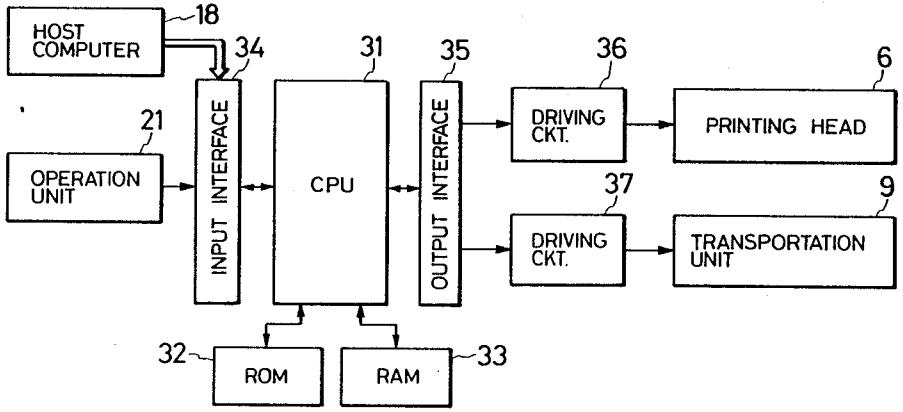
FIG. 5 is a block diagram showing a control system of the printer.

The printer having the construction described above is controlled by a control system as shown in FIG. 5. A central processing unit (CPU) 31 constitutes a control means to which a read-only memory (ROM) 32 and a random access memory (RAM) 33 are operatively connected. The ROM 32 stores program for controlling the operations of the printer and the data regarding the amount of upper margin of the print paper. The RAM 33 stores the operations of the printers corresponding to the functions of the switches 22 and the data regarding the amount of the renewal upper margin of the print paper.

The host computer 18 and the operation unit 21 are further operatively connected to the CPU 31 through an input interface 84 to input various kinds of signals to the CPU 31. The print head 6 and the transportation unit 9 are coupled to the CPU 31 through an output interfacee 35 and the associated drive circuits 36 and 37. The CPU 31 sends start or stop signal to the printing head 6 and the transportation unit 9 via the output interface 35 and the drive circuits 36 and 37.

The operation of the printer for determining the leading print line in the continuous print paper P1 will be described with reference to FIGS. 6A and 6B while referring to a flowchart shown in FIG. 7.

Under the closed condition of the lid member 24 as shown in FIG. 3, a printing mode for the print paper P1 is set in accordance with the lighting of the display lamp 23 which is selectively lit by the operations of a load switch **22*a* which is one of the function switches 22 (Step 1). The upper edge of the print paper is made to be in coincidence with a mark (not shown) on the pin tractor 11 and the print paper P1 is then loaded on the pin tractor 11 (Step 2). In this condition, a TOP switch 22*b*, which is also one of the function switches 22, is depressed (Step 3). Under the control of the CPU 31, the transportation unit 9 is operated in accordance with the data regarding a preset upper margin of the print paper stored in the ROM 32 (Step 4**), so that the continuous print paper P1 is transported by a predetermined length into the printer.

The operation knob 10 is then manually operated (Step 5) to move the continuous print paper P1 in the paper feeding direction. As shown in FIG. 6A, the print paper P1 is moved beyond the registration member 19. The print paper is outwardly extended from the registration member 19 for the amount corresponding to a desired upper margin S1 to be provided on the head portion of the print paper P1. When the desired upper margin is determined, a set switch **22*c*, which is also one of the function switches 22 and serves as a set operation means, is depressed (Step 6), the transporting unit 9 is operated under the control of the CPU 31 (Step 7), whereby the continuous print paper P1 backwardly moved by a predetermined distance S2 between the registration member 19 and the printing head 6. As shown in FIG. 6B, the leading print line of the print paper P1 is positioned to the print position of the printing head 6**. In this manner, the leading print line of the print paper P1 can be determined easily and exactly while visually confirming the desired print lead line. Once the position of the leading print line is set, the successively fed print paper is automatically set to the thus determined position.

Figure 8A:
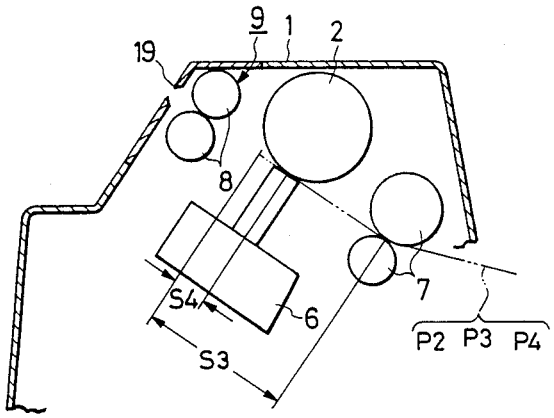
FIGS. 8A and 8B are cross sectional side views for description of an upper margin setting operation in the print paper.
Figure 9:
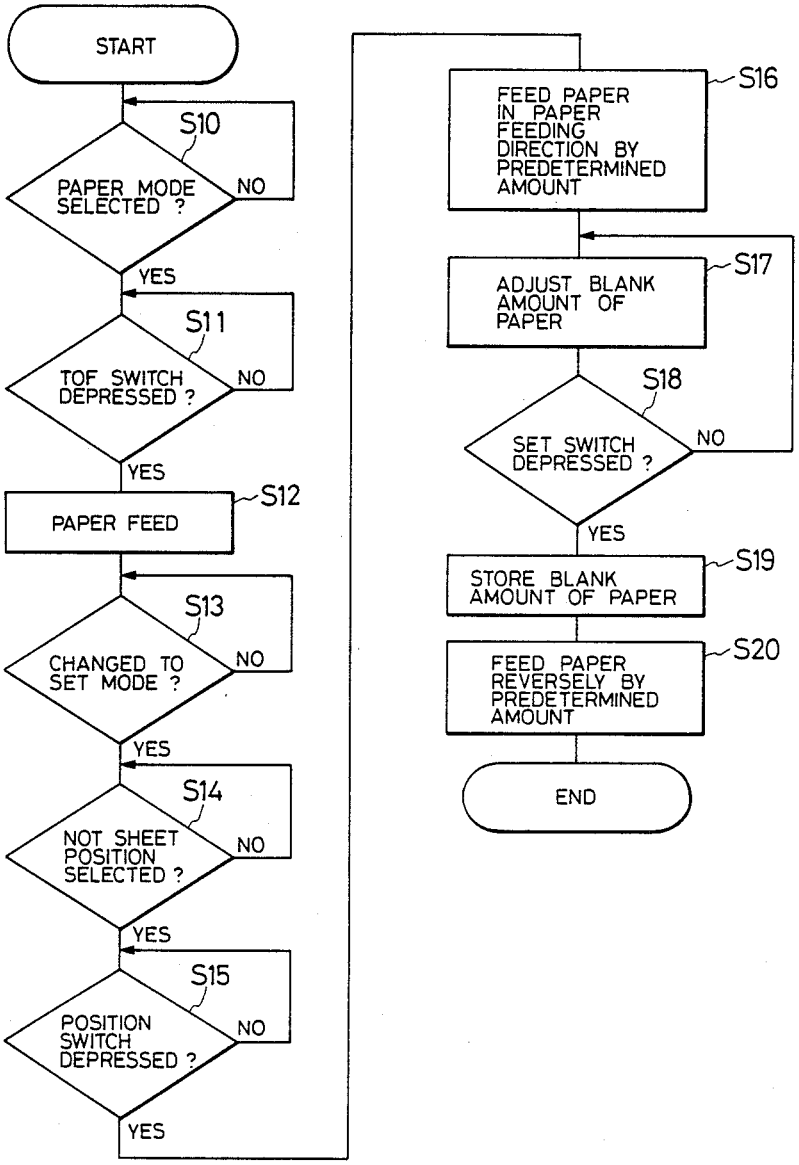
FIG. 9 is a flowchart for carrying out the upper margin setting operation.

The operation of the printer for setting the amount of upper margin in the print paper P2, P3 or P4 will be described with reference to FIGS. 8A and 8C while referring to a flowchart of FIG. 9.

Under the condition that the lid member 24 of the operation unit 21 is being closed as shown in FIG. 3, the load switch 22*g* is depressed to set the printing mode. A single sheet of the print paper P2 fed along the guide plate 12, the print paper P3 or P4 fed from the sheet cassette 14 or 15, or an envelop is selectively set in accordance with the lighting of the display lamp 23 which is lit by the operation of the load switch 22*a* (Step 10). When the TOP switch 22*b* is depressed (Step 11), the transportion unit 9 is operated (Step 12) under the control of the CPU 31 in accordance with the data stored in the ROM 32 regarding a preset upper margin of the selected print paper. The single sheet of the print paper P2, P3, or P4 is fed into the printer body 1 by a predetermined amount S3 as shown in FIG. 8A. In this condition, the upper margin is reserved for the amount of the length S4, and the leading print line of the print paper is aligned with the print position of the printing head 6.

When the lid member 24 is opened (Step 13) as shown in FIG. 4, the operation mode of the printer is changed from the on-line mode to the off-line mode, and at the same time, the functions of the respective switches 22 and display lamps 123 are changed to the functions described in the inner surface 29 of the operation unit 21 from those described in the outer surface 28 of the lid member 24.

Figure 8B:
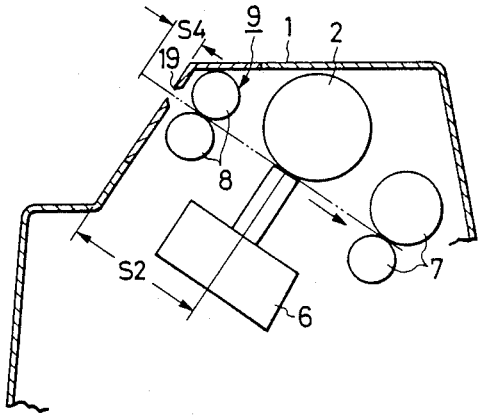

Under this condition, the function switch 22*a* is operated to select the paper position (Step 14), and a position switch 22*e*, which is one of the function switches 22, is thereafter depressed (Step 15). Then, the transportation unit 9 is activated under the control of the CPU 31 (Step 16) to forwardly transport the print paper P2 (P3 or P4) by the distance S2 between the registration member 19 and the printing head 6 so that the upper edge of the paper is extended beyond the registration member by the predetermined upper margin as shown in FIG. 8B.

Under this condition, whenever the switches 22*f* or 22*g* is operated (Step 17), the print paper P2 (P3 or P4) is either forwardly or backwardly moved by a small amount, whereby the length of the print paper extending from the registration member 19 can properly be adjusted. When a set switch 22*h* is depressed (Step 18), the changed amount S4 of the upper margin is stored in the RAM 33 as the renewal data regarding the upper margin of the print paper (Step 19). In the next step (Step 20), the print paper is backwardly moved by the distance S2 between the registration member 19 and the printing head 6 so that the leading print line of the print paper is positioned in the print position of the printing head 6 while reserving the changed upper margin S4, as shown in FIG. 8A.

Upon completion of the printing, the printed paper is discharged and then a print paper to be successively printed is fed into the printer along the transportation path. When the printer abuts the nip between the pair of rollers 7, the transportation means is driven in accordance with the actuation of a TOF (Top Of Forms) switch so that the print paper is transported in the forward direction by the sum of a distance S5 between the nip of the rollers and the print position and the previously determined distance S4 wherein distances S4 and S5 are read out of the memory. To summarize, once the amount of the upper margin is determined and stored, the successively inserted print papers are automatically set to the position where the same upper margin S4 is reserved when the first line is printed.

Figure 6A:
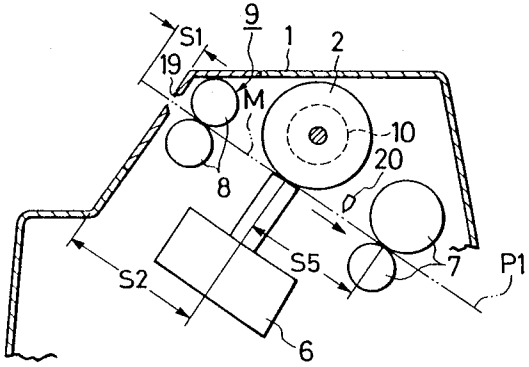
FIGS. 6A and 6B are cross-sectional side views for description of a leading print line setting operation of a continuous print sheet.
Figure 6B:
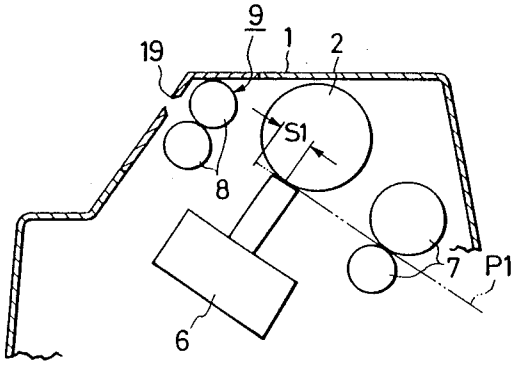
Figure 7:
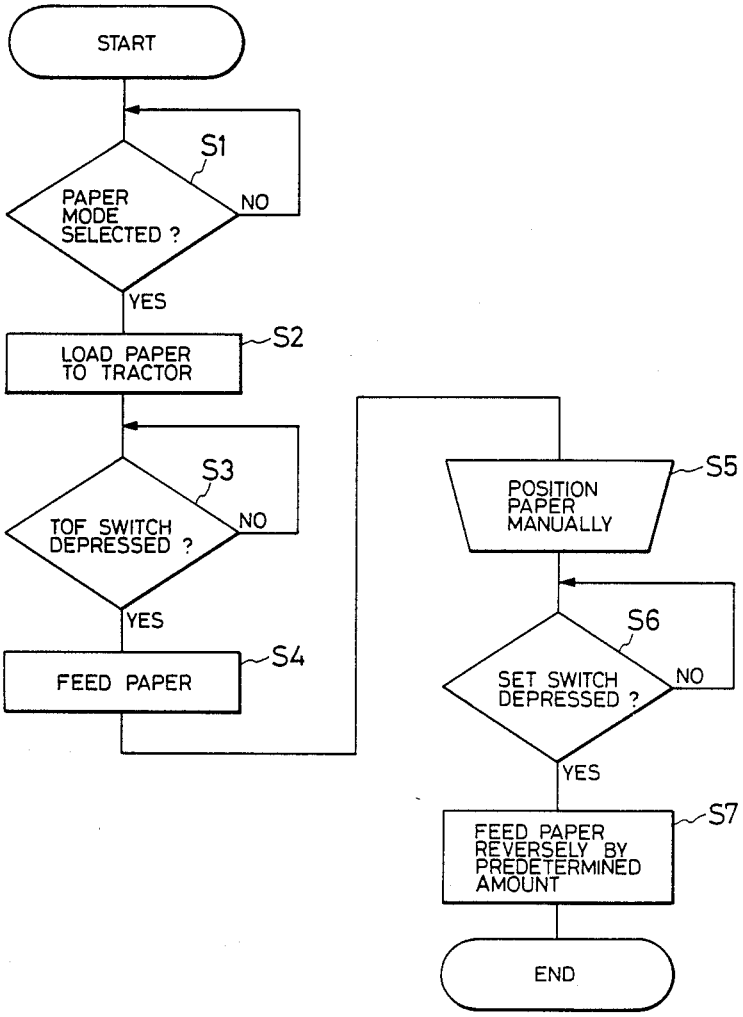
FIG. 7 is a flowchart for carrying out the leading print line setting operation.

Alternately, as shown in FIG. 6A, an optical edge sensor 20 may be provided between the platen 2 and the rollers 7 for sensing the upper edge of the print paper, upon the sensor 20 sensing the upper edge of the print paper, the print paper is transported by the sum of a distance between the sensor 20 and the print position and the distance S4.

Accordingly, as described above, under the closed condition of the lid member 24, the load switch 22*a* is operated to select the desired print paper, and thereafter, either the upper margin of a single sheet of print paper P2 fed from the guide plate, print gaper P3 or P4 fed from the sheet cassette 14 or 15, or an envelop can be set and stored by carrying out Steps 11 through Step 20. After the upper margin of the respective print papers or the envelop have been initially set and stored, only the load switch 22*a* may be depressed to select the printing mode for a desired print paper. Then, the transportation unit 9 is operated to reserve the changed upper margin, whereby the leading print line of the print paper is positioned in the print position of the printing head 6. The printing operation can then be started from the position thus set. Accordingly, after the desired amount of the upper margin of the print paper has been set, the printing operation can be automatically performed. Moreover, it is possible to set different amounts of upper margin for different size print papers. After the setting are complete, the printing operation can be performed simply by selecting the kind of the print paper without resetting the desired amount of upper margin.

Next, a print paper cutting operation will be described with reference to FIGS. 10 through 14.

Figure 11:
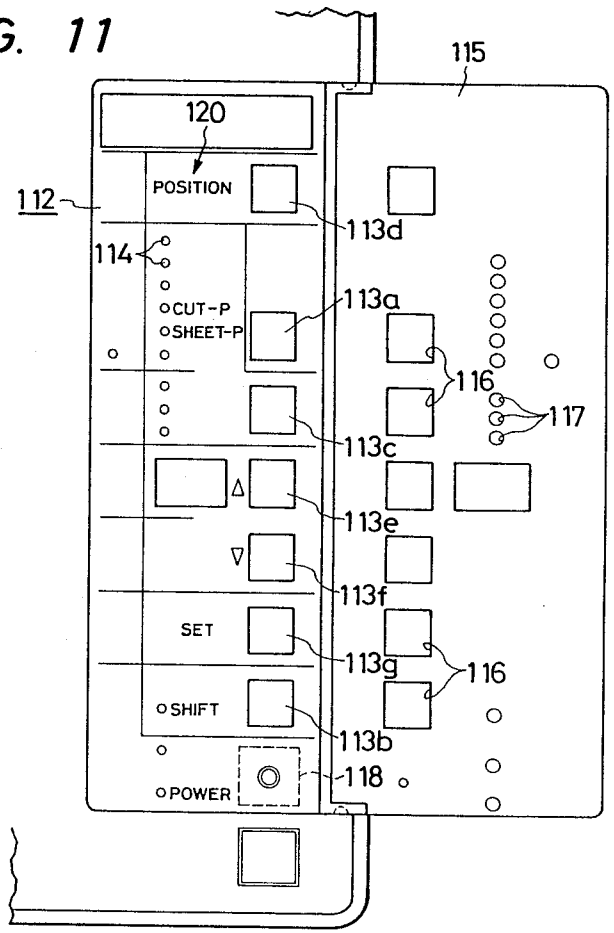
FIGS. 10 and 11 are top plan views for description of the different function.
Figure 10:
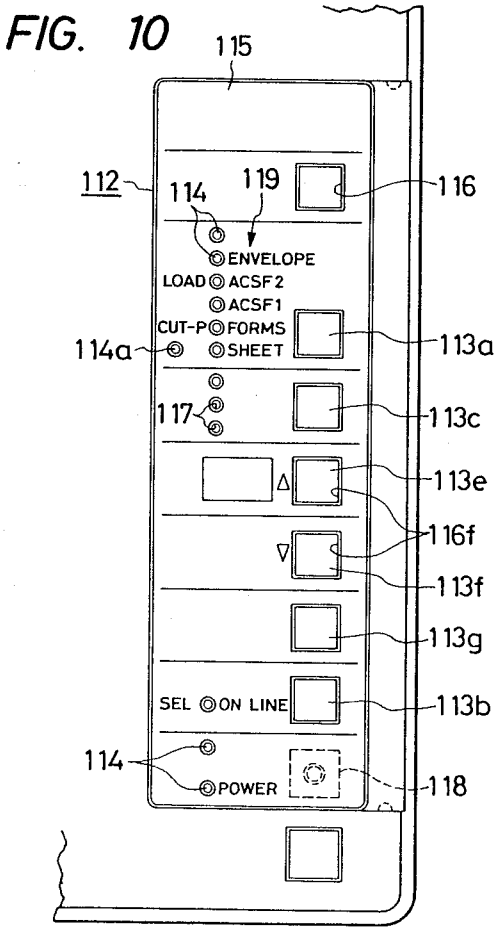

FIGS. 10 and 11 are illustrations of the operation unit and the lid and are substantially the same as those shown in FIGS. 3 and 4. Therefore, the details of the constructions or structures of the operation unit and the lid member of FIGS. 10 and 11 are omitted herein. The control system illustrated in FIG. 5 can also be applied to the operation unit 112 as shown in FIG. 10 or 11.

Figure 12A:
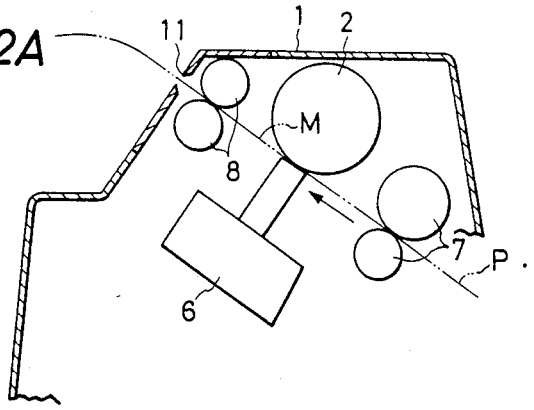
FIGS. 12A through 12C are cross sectional side views for description of the print paper cutting operation.
Figure 12B:
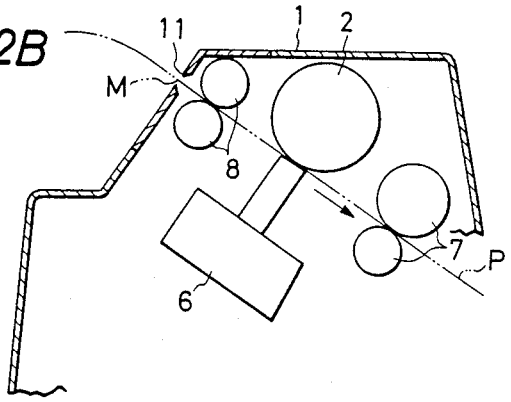
Figure 12C:
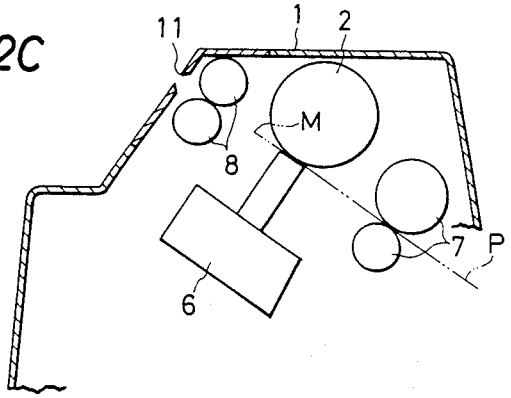
Figure 13:
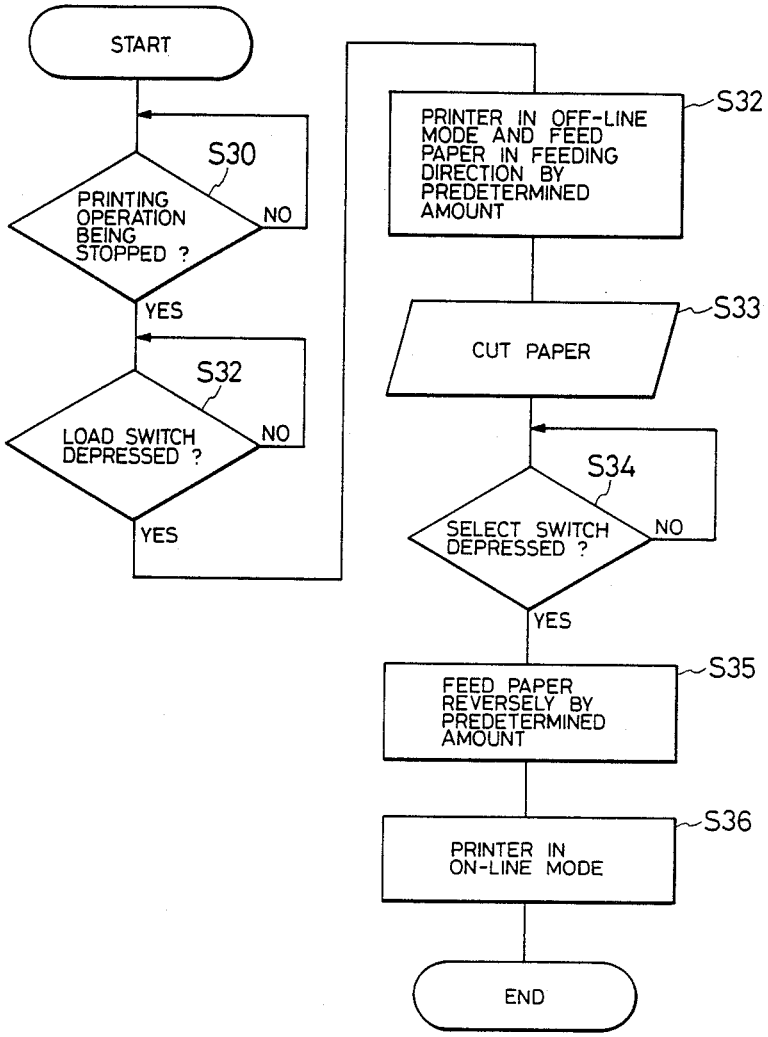
FIG. 13 is a flowchart for carrying out the print paper cutting operation.

Referring to FIGS. 12A through 12C and the flowchart of FIG. 12, when the lid member 115 of the operation unit 112 is closed rendering the printer in the on-line mode as shown in FIG. 10, a load switch 113*a*, which is one of the function switches 113, is depressed to select an operation mode for printing a continuous sheet of a print paper P. The printing operation is then carried out in accordance with output data from the host computer 18, and after the predetermined printing operation is carried out, a display lamp 114*a* for the paper cutting operation is lit to indicate the end of the printing operation (Step 30 in FIG. 13). Under this condition, when the load switch 113*a* is depressed (Step 31), the operation of the printer is changed from the on-line mode to the off-line mode under the control of the CPU 31 (Step 32) and a busy signal disabling receipt of the data from the host computer 18 is generated from the printer and sent to the host computer 18. At the same time, the transportation unit 9 is operated in response to the paper feed amount data stored in the RAM 33 to thereby transport the print paper by the predetermined amount in the forward direction from the stop position in FIG. 12A. A portion M of the print paper P, such as scored line along which the paper is cut, is positioned to confront the cutting blade 19A. The print paper P is thereafter cut by a manual operation along the scored portion M by means of the cutting blade 19A (Step 33). When a select switch 113*b*, which is also one of the function switches 113, is depressed (Step 34), the transporting unit 9 is driven under the control of the CPU 31 (Step 35) to backwardly move the print paper P by the predetermined distance equal to the distance between the cutting blade 19A and the printing head 6. As described earlier, the predetermined distance is stored in the ROM 32. Thus, the print paper is moved from the paper cutting position shown in FIG. 12C in which the upper edge of the print paper P is positioned to the print portion of the printing head 6. After the completion of the transportation, the operation of the printer is changed from the off-line mode to the on-line mode (Step 36) to stop the generation of the busy signal and enable printing operation. Accordingly, in a state in which the cutting blade 19A is arranged apart from the printing head 6, the print paper P can easily be cut along the predetermined cut line M. After the paper cutting operation, the print paper is reversely transported to a position in which the upper edge of the print paper P is aligned with the print position of the printing head 6, whereby the printing operation can be carried out without leaving wide upper margin at the head portion of the print paper. Moreover, since the printer is not in the on-line operation mode during paper transporting and paper cutting, no signal is inputted from the host computer 18. This assure that the printer is not erroneously operated during these operation.

Figure 14:
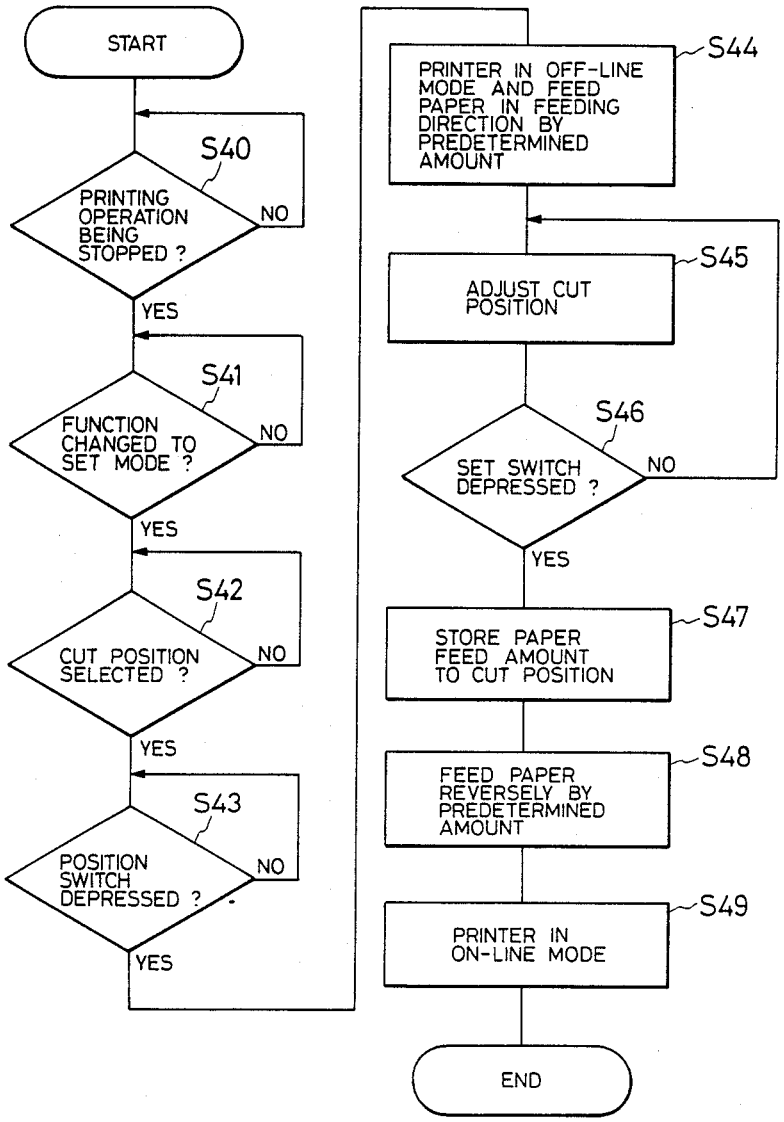
FIG. 14 is a flowchart for carrying out an adjustment of a portion of the print paper to be cut.

The adjustment of the cut line of the print paper P will be described with reference to the flowchart of FIG. 14. As shown in FIG. 12B, the cut position M displaces from the cutting blade 11 when the print paper P is moved, and therefore the adjustment of the displacing needs to be corrected.

It is first confirmed (Step 40) as in Step 30 in FIG. 12 that the printer is under the printing operation stop condition. When the lid member 115 is opened as shown in FIG. 11 (Step 41), the printing operation of the printer is changed from the on-line mode to the off-line mode and the functions of the respective function switches 113*a* to 112*g* and the display lamps 114 are changed from those described on the outer surface 119 of the lid member 115 to those described on the inner surface 120 of the operation unit 112. Under this condition, in the next step (Step 42), the function switch 113*c* is operated to select the cut position. When a position switch 113*d* is thereafter depressed (Step 43), the transporting unit 9 is operated (Step 44) in accordance with the data regarding the paper feed amount stored in the RAM 33. Under the control of the CPU 31, the print paper P is transported in the print paper feeding direction from the paper stop position shown in FIG. 12A to the paper cutting position shown in FIG. 12B. Adjustment switch 113*e* or 113*f* is operated (Step 45) so that the print paper P is transported either in the forward feed direction or backward direction due to the operation of the transportation unit 9. Thus, the displacement of the cut position M is adjusted, a set switch 113*g* is depressed (Step 46) so that the adjusted data regarding the paper feed amount from the aforementioned paper stop position to the paper cut line is stored in the RAM 33 (Step 47). The print paper P is then reversely moved to the print position in FIG. 12C by the predetermined distance (Step 48). In the next step (Step 49), the lid member 115 being in opened state as shown in FIG. 11 is closed as shown in FIG. 10 to render the printer in on-line mode. In accordance with the lid member closing operation, the functions of the function switches 113*a* to 113*g* and the display lamps 114 are changed to those described on the outer surface 119 of the lid member 115. After these operations, the transportation unit 9 is operated in the step 42 in accordance with the adjusted paper feed amount data stored in the RAM 33 so that the position of the print paper P to be cut therealong always accords with the location of the cutting blade 19A.

As described above, according to one aspect of the invention, the upper margin of the print paper can be determined and adjusted easily and exactly while visually confirming the amount of the upper margin from outside the printer. In another aspect of the invention, the print paper can be cut along a predetermined line of the print paper. After cutting the print paper, the paper is backwardly transported by the predetermined amount, so that the proper upper margin is reversed in the print paper.

It will be understood by a person skilled in the art that this invention is not limited to the preferred embodiments described and various modifications and changes may be made without departing from the spirit and scope of the invention.

What is claimed is:

1. A recording apparatus comprising:

recording means for recording data on a recording medium having a leading edge;

accommodating means for accommodating at least said recording means;

transporting means for transporting said recording medium in a first direction along a transportation path to positions external to said accommodating means after the record of data and for transporting said recording medium of predetermined distance in a second direction opposite said first direction;

registration means for defining a reference line substantially perpendicular to said leading edge of said recording medium, said registration means being attached to said accommodating means and being visible from outside said accommodating means, said registration means further being spaced said predetermined distance from said recording means along said transportation path;

aligning means for positioning said leading edge a selected distance from said registration means to align a selected first print line position with said registration means; and control means for controlling said transporting means to transport said first line position of said recording medium said predetermined distance in said second direction to align said selected first print line position with said recording means.

2. A recording apparatus as claimed in claim 1, further comprising a means for feeding said recording medium to said transporting means.

3. A recording apparatus as claimed in claim 2, wherein said feeding means comprises a pin tractor.

4. A recording apparatus as claimed in claim 2, wherein said feeding means further comprises a cassette in which said recording mediums are stacked, and a feed-out roller provided in association with said cassette for feeding out an uppermost recording medium stacked in said cassette.

5. A recording apparatus as claimed in claim 1, wherein said transporting means comprises a first pair of feed rollers disposed in the transportation path and having a first nip therebetween; a second pair of feed rollers disposed in the transportation path and having a second nip therebetween; a platen having two ends rotatably secured to said accommodating means and confronting said recording means, a space being provided between said platen and said recording means; a motor; and, a gear means, wherein said first and second pairs of feed rollers and said platen being rotated through said gear means by said motor and wherein said recording medium is adapted to pass through said first and second nips and said space.

6. A recording apparatus as claimed in claim 5, wherein said aligning means comprises an operation knob coupled to said gear means to be capable of rotating said first and second pairs of feed rollers and said platen, said operation knob being positioned outside of said accommodating means.

7. A recording apparatus as claimed in claim 1, further comprising a data supplying means for supplying an input data to said recording means, said recording means carrying out recording operation in response to said input data.

8. A recording apparatus as claimed in claim 7, wherein said data supplying means comprises a host computer.

9. A recording apparatus as claimed in claim 8, further comprising a switch means for selectively rendering said recording apparatus in an on-line mode enabling to receive said input data from said host computer and an off-line mode disabling to receive said input data therefrom.

10. A recording apparatus as claimed in claim 1, wherein said aligning means includes a first switch means coupled to said transporting means, said transporting means being responsive to an output of said first switch means and transporting said recording medium in said first direction by said predetermined distance.

11. A recording apparatus as claimed in claim 10, wherein said aligning means further includes a second switch means coupled to said transporting means, said transporting means being further responsive to an output of said second switch and transporting said recording medium in said first direction or said second direction to align said selected first print line position with said registration means, said distance between said leading edge and said registration means defining an upper margin length.

12. A recording apparatus as claimed in claim 11, further comprising a memory means for storing said upper margin length.

13. A recording apparatus as claimed in claim 12, wherein said control means includes a third switch means, said first distance being stored in said memory means and said recording medium being moved in said second direction responsive to an output of said third switch means.

14. A recording apparatus as claimed in claim 12, further comprising a second control means for controlling said transporting means to move said recording medium in said first direction so that said selected first print line spaced said upper margin length from said leading edge confronts said recording means.

15. A recording apparatus as claimed in claim 12, further comprising a plurality of feeding means for feeding said recording medium to said transporting means, and a selecting means for selecting one of said plurality of feeding means, and wherein said memory means stores said first distance for each of said plurality of feeding means.

16. A recording apparatus as claimed in claim 1, wherein said registration means comprises an elongated blade disposed on the accommodating means alongside and perpendicular to said transportation path.

* * * * *